US008016224B2

(12) United States Patent
Bandholz et al.

(10) Patent No.: US 8,016,224 B2
(45) Date of Patent: Sep. 13, 2011

(54) EDGE GUIDE FOR FLEXIBLE WEB

(75) Inventors: Brent A. Bandholz, Hubertus, WI (US); Richard L. Carriere, Oak Creek, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 465 days.

(21) Appl. No.: 11/954,098

(22) Filed: Dec. 11, 2007

(65) Prior Publication Data

US 2008/0174064 A1 Jul. 24, 2008

Related U.S. Application Data

(60) Provisional application No. 60/869,618, filed on Dec. 12, 2006.

(51) Int. Cl.
*B65H 23/04* (2006.01)
*B41J 15/00* (2006.01)

(52) U.S. Cl. ..... 242/615.3; 226/196.1; 400/619

(58) Field of Classification Search ..... 242/615.1, 242/615.2, 615.3; 226/196.1; 400/619, 633–633.2, 400/642; 347/101, 104; 271/240, 248, 264
See application file for complete search history.

(56) References Cited

U.S. PATENT DOCUMENTS

| | | | | |
|---|---|---|---|---|
| 3,071,157 | A | | 1/1963 | Robertson |
| 3,512,691 | A | | 5/1970 | Neifeld |
| 3,968,917 | A | | 7/1976 | Lanahan |
| 4,069,959 | A | | 1/1978 | Bartell et al. |
| 4,534,523 | A | | 8/1985 | Zarr |
| 4,795,070 | A | | 1/1989 | Blanding et al. |
| 5,055,874 | A | | 10/1991 | Kralles et al. |
| 5,213,246 | A | * | 5/1993 | Crowley ..... 226/88 |
| 5,279,454 | A | | 1/1994 | Morse et al. |
| 5,657,983 | A | | 8/1997 | Fisk |
| 5,701,171 | A | | 12/1997 | Roy et al. |
| 5,938,190 | A | | 8/1999 | Campbell et al. |
| 6,068,418 | A | | 5/2000 | Fox |
| 6,501,620 | B1 | | 12/2002 | Wojciechowski |

(Continued)

FOREIGN PATENT DOCUMENTS

JP 05278914 A * 10/1993

(Continued)

OTHER PUBLICATIONS

Machine translation of JP 05-278914 A.*

*Primary Examiner* — William E Dondero
(74) *Attorney, Agent, or Firm* — Whyte Hirschboeck Dudek SC

(57) ABSTRACT

An edge guide is described that is adapted to restrict lateral movement of a flexible web as the web advances past the guide, the web comprising top and bottom face surfaces and two lateral edge surfaces, the guide comprising (i) a multi-sided body, and (ii) a cavity in one side of the body, the cavity comprising (a) a curved support surface adapted to receive a first lateral edge and to support a portion of the bottom face surface of the web as the web moves laterally into the cavity of and advances past the guide, and (b) a hard stop above, and in one embodiment, continuous with the curved support surface, the stop adapted to engage the first lateral edge of the web and block any further lateral movement of the web over the curved support surface.

9 Claims, 2 Drawing Sheets

U.S. PATENT DOCUMENTS

| | | | | |
|---|---|---|---|---|
| 6,570,602 | B1 | 5/2003 | Miller | |
| 6,616,360 | B2 | 9/2003 | Lehmkuhl | |
| 6,620,055 | B2 | 9/2003 | Saso | |
| D480,749 | S | 10/2003 | Milton et al. | |
| D481,414 | S | 10/2003 | Milton et al. | |
| D481,415 | S | 10/2003 | Fisher et al. | |
| 6,742,858 | B2 | 6/2004 | Lehmkuhl et al. | |
| 6,768,502 | B2 | 7/2004 | Milton | |
| 6,788,324 | B2 | 9/2004 | Fisher et al. | |
| 6,788,325 | B2 | 9/2004 | Miller | |
| 6,902,161 | B2 * | 6/2005 | Gordon et al. | 271/161 |
| 2007/0155524 | A1 | 7/2007 | Cameron | |

FOREIGN PATENT DOCUMENTS

| | | |
|---|---|---|
| WO | 0134506 | 5/2001 |

* cited by examiner

EDGE GUIDE FOR FLEXIBLE WEB

CROSS-REFERENCE TO RELATED APPLICATION

This application claims the benefit of U.S. provisional application No. 60/869,618 filed Dec. 12, 2006.

FIELD OF THE INVENTION

This invention relates to flexible webs. In one aspect, the invention relates to guiding a flexible web through a device while in another aspect, the invention relates to guiding a flexible web through a printer. In still another aspect, the invention relates to an edge guide for guiding a flexible web through a printer.

BACKGROUND OF THE INVENTION

Guiding a flexible web, e.g., paper, thin plastic sheets, metal foil, etc., through a device, e.g., a printer, such that the web stays in registration with a functional component of the device that is to act on the web, e.g., a printer head or web cutter, is difficult. The drive force that advances the web downstream, e.g., a grit textured drive roller with spring-loaded rubber nip roller, can also produce a side force. The magnitude of this side force is a function of a number of variables including roller alignment, irregular nip pressure, and the friction between the drive/nip rollers and the web.

The long-standing response to this problem of a side force acting on a web advancing through a device so as to move the web in a sideways manner and thus lose registration of the web within the device is the use of one or more edge guides. U.S. Pat. No. 3,968,917 teaches the use of an edge guide comprising a base plate secured to an edge plate in an L-shaped configuration such that one lateral edge of a relatively stiff web is always in contact with the edge plate as it passes over the base plate. U.S. Pat. No. 4,069,959 teaches a web guide apparatus that includes a steering frame over which a traveling web is passed and which is pivotally mounted to a stationary support frame. U.S. Pat. No. 4,534,523 teaches tape guides which comprise cylinders with shoulders on each end. The tape passes over the cylinders and between the shoulders as it advances through a tape cartridge. U.S. Pat. No. 4,795,070 teaches a mechanism for maintaining a moving web in its proper path along an edge guide. The edge guide is a simple flattened U-shaped plate pivotally supported on a frame and that can pivot about an axis perpendicular to the moving web. U.S. Pat. No. 5,055,874 teaches a film flattening apparatus that comprises, among other things, edge guides opposite one another and mounted on a base. The guides are simple plates extending above the base and in contact with the lateral edges of the advancing film.

U.S. Pat. No. 5,279,454 teaches a system of establishing the lateral position of a web without requiring the web path to change direction. The system comprises a lateral edge guide joined to a support surface to form an obtuse angle. The angle is obtuse to prevent escape of the advancing web, and the support surface is curved in its transverse direction concave towards the web. A roller is positioned against the support surface so as to urge the advancing web against the lateral edge guide.

Still other edge guides are known in the art. U.S. Pat. No. 5,657,983 teaches a registration guide member with a wear-resistant inboard surface. U.S. Pat. No. 5,701,171 teaches a pair of oppositely facing, substantially parallel edge guides supported by a frame, each edge guide comprising a serpentine contact surface with a central portion for engaging an edge surface of a web moving between the guides. U.S. Pat. No. 5,938,190 teaches a replaceable media guide for use with a sheet feeding mechanism. The media guide includes a support plate, an edge guide projecting substantially at right angles from the support plate, and a first sheet engaging a friction pad engaged with the support plate. U.S. Pat. No. 6,068,418 teaches a retractable outer edge guide for use with a print station and a guide path extending from the station to a media roll station. U.S. Pat. No. 6,501,620 teaches an edge guide with top and bottom guide surfaces for engaging the top and bottom edges of a web as it passes through the guide. The edge guide is used in combination with a face guide.

Standard edge guides for printers have one of two profiles, i.e., flat and concave. Edge guides with a flat profile are basically plates fastened perpendicular to the web-supporting platform. Edge guides with a concave profile have a square cavity as shown in FIG. 1. Edge guide 10 comprises interior surfaces 12*a*, 12*b* and 12*c* which define rectangular cavity 11. Flexible web 13 moves over a support platform (not shown) and due to side force 14, moves over lower surface 12*a* and into cavity 11. Flexible web 13 continues to move over lower surface 12*a* until it encounters vertical surface 12*b* at which point it bends and moves over vertical surface 12*b* until it encounters top surface 12*c*. Upon encountering top surface 12*c*, web 13 bends again and forms web curl 15 which is frequently the source of a web jam or web tear.

The standard edge guide is a simple and desirable tool for maintaining a flexible web in registration with another component of a device as the web advances through the device, but a better design is of interest to the extent that it results in reduced or elimination of web jams or web tears.

SUMMARY OF THE INVENTION

In a first embodiment, the invention is an edge guide adapted to restrict lateral movement of a flexible web as the web advances past the guide, the web comprising top and bottom face surfaces and two lateral edge surfaces, the guide comprising (i) a multi-sided body, and (ii) a cavity in one side of the body, the cavity comprising or defined by (a) a curved (concave relative to the web) support surface adapted to receive a first lateral edge and to support a portion of the bottom face surface of the web as the web moves laterally into the cavity of and advances past the guide, and (b) a hard stop above, and in certain embodiments, continuous with the curved support surface, the stop adapted to engage the first lateral edge of the web and block any further lateral movement of the web over the curved support surface.

In a second embodiment the invention is an apparatus, e.g., a printer, comprising the edge guide of the first embodiment.

DESCRIPTION OF THE PREFERRED EMBODIMENTS

Various embodiments of the invention are described by reference to the drawings in which like numerals are employed to designate like parts. Various items of equipment, such as fittings, mountings, fasteners, base plates and the like, have been omitted so as to simplify the description, but such conventional equipment can be employed as desired. Moreover, although the following description is in the context of a printer, this is but one embodiment of this invention. Other embodiments, e.g., copiers, photographic equipment, etc., are possible.

Figure 1:
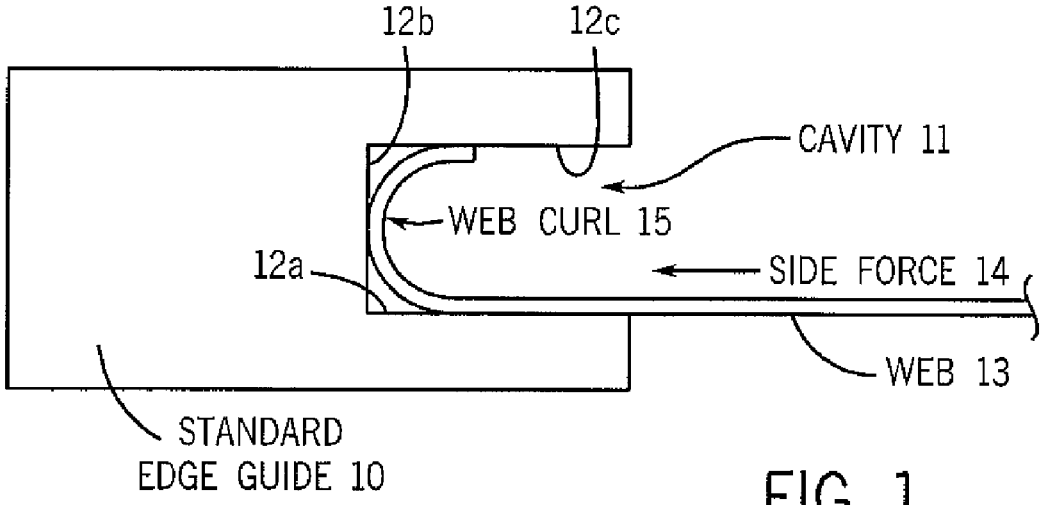
FIG. 1 PRIOR ART
FIG. 1 is a schematic of a prior art edge guide.
Figure 2A:
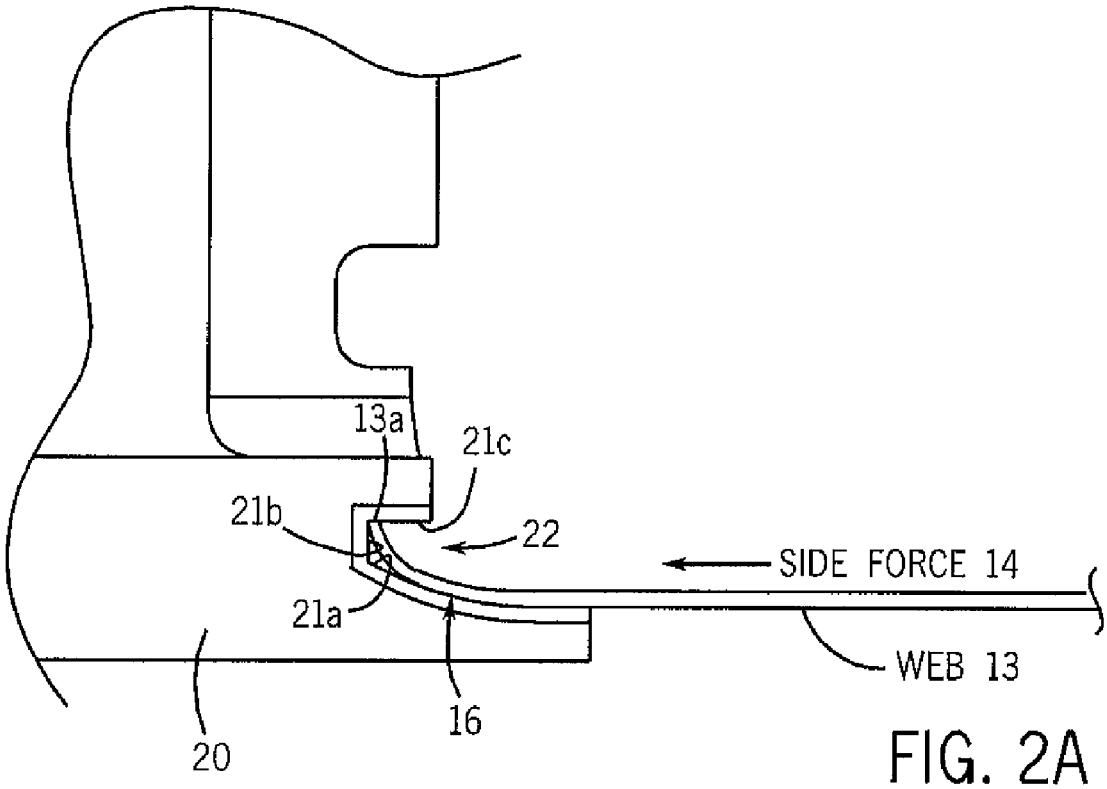
FIG. 2A is a schematic of one embodiment of an edge guide of this invention.
Figure 2B:
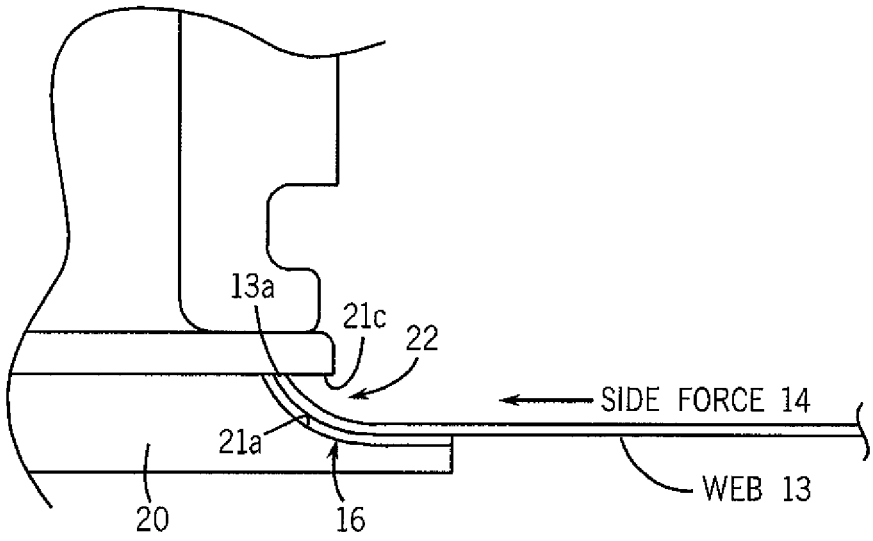
FIG. 2B is the schematic of FIG. 2A with a cavity not having an interior vertical surface or wall.

FIG. 2A illustrates a multi-sided edge guide 20 having interior surfaces 21*a*, optional 21*b*, and 21*c* defining curved cavity 22 in one side of the guide. FIG. 2B shows the same multi-sided edge guide of FIG. 2A except without optional interior surface 21*b*. Edge guide 20 can be made of any material, and is typically made of a material, e.g., a metal such as stainless steel or an engineering plastic, that is harder than the material from which the web is made. It can also bear one or more coatings, e.g., a friction-reducing coating, particularly on one or more interior surfaces. The overall size and dimensions of the edge guide are determined by the size of the equipment upon which it is installed and the flexible web which it must guide. Web 13 can comprise any material, e.g., paper, plastic, paper-plastic composites, label material and liner, etc., and its flexibility can vary widely but it is typically of sufficient flexibility that misregistration, curling, jamming and/or tearing can be a problem if the web moves too much off its designed path through the device.

Figure 2C:
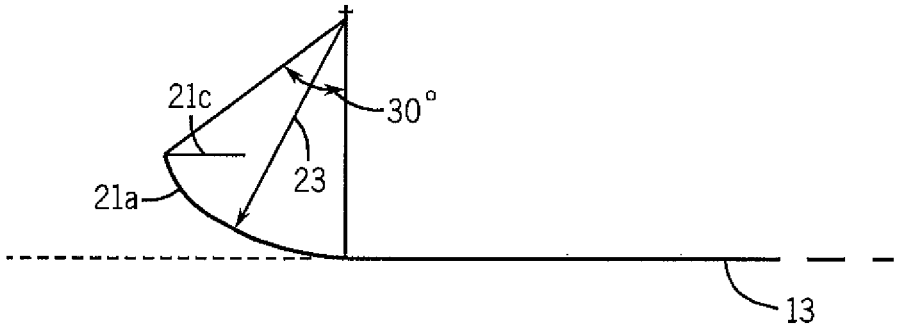
FIG. 2C is shows the measurement of the radius of FIGS. 2A and 2B.

Flexible web 13 moves over a supporting platform (not shown) and due to side force 14, moves over interior lower surface 21*a* and into curved cavity 22. In one embodiment, interior lower surface 21*a* has a radius of curvature 23 of about 0.38 inches at 30 degrees from the tangency of web plane 13 as illustrated in FIG. 2C. Side force 14 continues to move web 13 over lower surface 21*a* and into cavity 22 until lateral edge 13*a* of web 13 encounters optional vertical wall 21*b* at which point web 13 bends upward. If present, optional vertical wall 21*b* is typically slightly larger than the thickness of web 13, e.g., if web 13 is 0.02 inches thick, then optional vertical wall 21*b* is about 0.022 inches. If optional vertical wall is much greater than the thickness of the web, then the web has more room to move laterally which is undesirable. If optional wall 21*b* is not present, then lower surface 21*a* ends at the point where it meets top wall 21*c* (which acts as a hard stop to the lateral movement of web 13 into cavity 22). The angle formed by the meeting of lower surface 21*a* and top wall 21*c* is a right or an acute angle. Preferably, optional vertical wall 21*b* is present because it helps keep the web from binding at top surface 21*c*.

The depth of cavity 22 and the radius of lower surface 21*a* are functions of, among other things, the width of the web, the nature and thickness of the web material, the radius of the lower surface, and the precision or registration required of the web when it enters a station in which some function will be performed on it, e.g., printing, cutting, etc. For a plastic web of 0.02 inches thickness, a lower surface radius of curvature of about 0.38 inches at 30 degrees from the tangency of the web plane, and a vertical side height of 0.022 inches, the depth of cavity 22 is preferably about 0.232 inches (which is the lateral distance from vertical wall 21*b* to the front edge of lower surface 21*a*).

Side force 14 continues to act on web 13 until lateral edge 13*a* encounters top surface 21*c* which acts as a hard stop, i.e., a point at which side force 14 can no longer move web 13 further into cavity 22. This design offers resistance to web 13 curling onto itself, and thus promotes continued advance of the web through the apparatus without jamming or tearing. Of course like any design, if the side force is sufficiently strong, ultimately the web will jam or tear but the edge guide design of this invention will keep the web advancing through the apparatus without jam or tear under a greater side force than will an edge guide of conventional rectangular cavity design because the concavity of lower surface 21*a* materially increases the compressive strength of the web.

Figure 3:
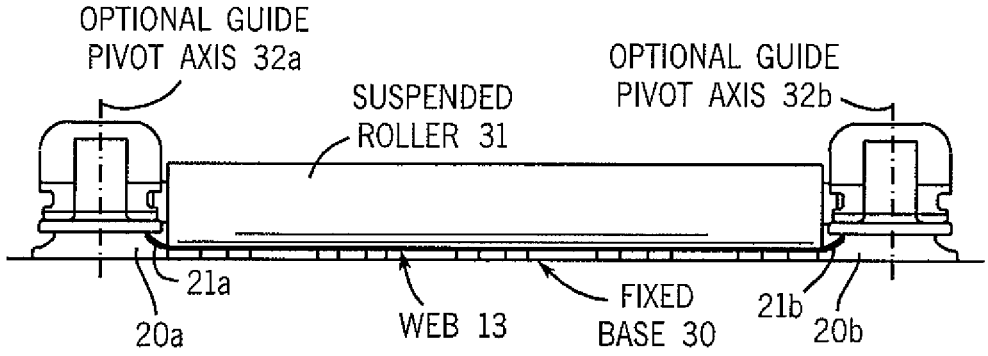
FIG. 3 is a schematic of the edge guide of FIG. 2A incorporated into an apparatus through which a flexible web moves.

FIG. 3 shows a pair of edge guides 20*a* and 20*b* incorporated into a printer comprising fixed base 30 which supports moving, flexible web 13. Lower interior surfaces 21*a* and 21*b* are tangent to the top surface of fixed base 30, and roller 31 is suspended above web 13 providing only minimal clearance between it and the top face surface of the web. The motive force for advancing web 13 through the printer is not shown, but it or one or more other components (not shown) of the printer can be the source of side force 14 (not shown in FIG. 3). The side force can act in any sideways direction, e.g., towards edge guide 20*a* or towards edge guide 20*b*. Edge guides 20*a* and 20*b* can either be stationary or each can pivot independently about pivot axes 32*a* and 32*b*, respectively. The ability of the guides to pivot about axes 32*a* and 32*b* can reduce turbulence in the advancing web, improve contact between the web and the guide, and reduce the amount of stress imparted to the web from its lateral movement as it advances passes by the guides. While the edge guides provide support for the flexible web inside the guides, the web can buckle between the guides. Suspended roller 31 and fixed base 30 provide support for the web between the guides and act to suppress any such inter-guide buckling. In another embodiment, suspended roller 31 is replaced with a fixed upper support (not shown) to achieve the same support effect.

Although the invention has been described in considerable detail by reference to the attached drawings and the edge guide incorporated into a printer, this detail is for the purpose of illustration and is not to be construed as a limitation on the scope of the invention as it is described in the appended claims. All U.S. patents and published U.S. patent applications identified above are incorporated herein by reference.

What is claimed is:

1. An apparatus comprising (A) a flat, fixed base having a top surface to support an advancing, flexible web, the web comprising top and bottom face surfaces and two lateral edge surfaces, and (B) a pair of web guides, each guide comprising (i) a multi-sided body, and (ii) a cavity in one side of the body, the cavity comprising (a) a curved support surface tangent to the top surface of the fixed base and adapted to receive a first lateral edge and to support a portion of the bottom face surface of the web as the web moves laterally into the cavity of and advances past the guide, and (b) a hard stop above and continuous with the curved support surface, the stop adapted to engage the first lateral edge of the web and block any further lateral movement of the web over the curved support surface, each guide separately attached to the apparatus and spaced apart from one another on opposite sides of the fixed based.

2. The apparatus of claim 1 in which the apparatus is a printer.

3. The printer of claim 2 in which the curved support surface of each edge guide has a radius of curvature of about 0.38 inches at 30 degrees from the tangency of the plane of the web.

4. The printer of claim 2 in which the curved support surface of each edge guide is adapted to receive at least about 5 percent of the total width of the web.

5. The printer of claim 2 in which the guides are positioned opposite one another and define a machine direction path for the advancing web.

6. The printer of claim 2 further comprising a roller suspended over the fixed base in a manner such that it diminishes or prevents buckling of the advancing web.

7. The printer of claim 2 in which each web guide can pivot about a pivot axis.

8. The printer of claim 2 in which each edge guide further comprises a vertical wall positioned between the curved support surface and the hard stop.

9. The printer of claim 8 in which the vertical wall of each edge guide is 10 percent or less larger than the thickness of the flexible web.

* * * * *